US005558327A

United States Patent [19]

Hansen et al.

[11] Patent Number: 5,558,327

[45] Date of Patent: Sep. 24, 1996

[54] PINBALL WAND

[75] Inventors: Bryan P. Hansen, Des Plaines; Roberto Hurtado, Elmwood Park, both of Ill.

[73] Assignee: Capcom Coin-Op, Inc., Arlington Heights, Ill.

[21] Appl. No.: 409,998

[22] Filed: Mar. 24, 1995

Related U.S. Application Data

[63] Continuation of Ser. No. 382,373, Feb. 1, 1995, abandoned, which is a continuation-in-part of Ser. No. 255,657, Jun. 8, 1994, Pat. No. 5,452,894.

[51] Int. Cl.[6] ..... A63F 7/30

[52] U.S. Cl. ..... 273/121 A; 273/119 A; 273/127 R

[58] Field of Search ..... 273/118, 119, 273/121, 127

[56] References Cited

U.S. PATENT DOCUMENTS

| | | | |
|---|---|---|---|
| 5,120,059 | 6/1992 | Oursler | 273/118 A X |
| 5,351,954 | 10/1994 | Oursler et al. | 273/121 A X |
| 5,356,142 | 10/1994 | Borg et al. | 273/118 A X |
| 5,358,242 | 10/1994 | Trudeau et al. | 273/121 A X |

*Primary Examiner*—Raleigh W. Chiu
*Attorney, Agent, or Firm*—Gary R. Jarosik

[57] ABSTRACT

A wand for a pinball game which carries a pinball from one position to another by electromagnetism. The pinball rolls along the bottom surface of the wand as the wand is rotated to move the pinball from one position to another. A platform is provided to orient the pinball with respect to the wand whereby side-to-side movement of the pinball is minimized.

8 Claims, 9 Drawing Sheets

30A
56
62
22
60
55A
55B
52
54
66
64
58
164
165

PINBALL WAND

RELATED APPLICATIONS

This application is a continuation of U.S. patent application Ser. No. 08/382,373 filed Feb. 1, 1995, now abandoned, which in turn is a continuation-in-part of U.S. patent application Ser. No. 08/255,657, filed Jun. 8, 1994, entitled "Pinball Wand", now U.S. Pat. No. 5,432,894.

FIELD OF THE INVENTION

This invention relates to pinball machine and more particularly relates to such a machine in which a pinball is carried from one location to another.

DESCRIPTION OF THE PRIOR ART

As far as the applicant is aware, a pinball wand of the type described in this specification is a new innovation. Although pinball games have picked up and carried pinballs from one location to another in the past, as far as the applicant is aware, such games have not employed electromagnetic means of the type claimed in this application.

SUMMARY OF THE INVENTION

In order to add sufficient variety to a pinball game to hold the interest of a player, it is advantageous to provide a means of carrying a pinball from one location to another in response to proper aiming of the pinball by the player. By employing the unique electromagnet described in the specification, a pinball player is given the illusion that a "magic" wand has picked up the pinball and guided it from one path to another. The pinball appears to be suspended from the under side of the wand and gives the illusion of defying gravity. Such a device adds to the enjoyment of the game and gives a player incentive to use the feature as often as possible in order to watch the wand carry the pinball contrary to the law of gravity.

Accordingly, it is an object of the present invention to provide an improved pinball game electromagnet that simulates a magic wand capable of carrying a pinball from one path to another.

Another object of the present invention is to provide an electromagnet of the foregoing type which is rotatable and which can carry a pinball from one ramp to another.

Still another object of the present invention is to provide an electromagnet of the foregoing type in which a pinball player receives the illusion that the pinball is carried on the underside of a wand, thereby appearing to defy gravity.

The invention is useful for a target for pinball games utilizing a pinball rolling on a game surface. In such an environment, a preferred form of pinball target made in accordance with the invention includes an electromagnet capable of carrying the pinball below the electromagnet. A first path guides the pinball to a first location adjacent the electromagnet. A movement means rotates the electromagnet. Control means energizes the electromagnet while the pinball is on the first path adjacent the electromagnet so that said pinball is carried by the electromagnet. The control means also energizes the movement means so that the pinball is moved away from the first path while being carried by said electromagnet and deenergizes said electromagnet so that said pinball is released from said electromagnet in a second location displaced from the first location.

BRIEF DESCRIPTION OF THE DRAWINGS

These and other objects, advantages and features of the invention will appear for purposes of illustration, but not of limitation, in connection with FIGS. 1–10 wherein like numbers refer to like parts throughout and in which.

DETAILED DESCRIPTION OF THE PREFERRED EMBODIMENTS

Figure 1:
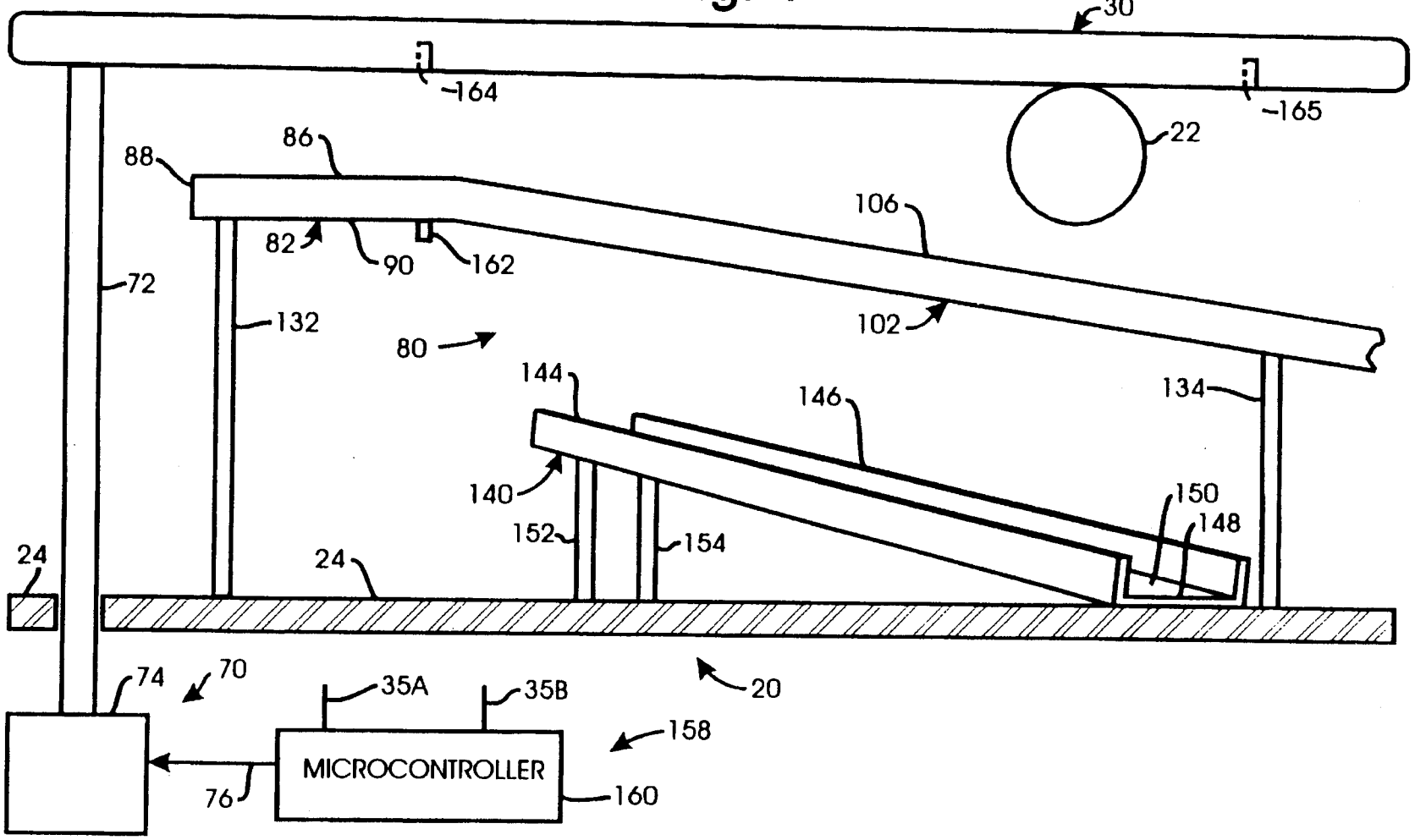
FIG. 1 is a fragmentary, side elevational view of a preferred form of wand made in accordance with the invention shown in connection with a pinball game in which a pinball is being carried adjacent the bottom surface of the wand.

Referring to FIG. 1, the preferred embodiment is preferably used with a pinball game 20 employing a pinball 22 rolling on a pinball game playing surface 24. The preferred embodiment basically comprises a cantilevered electromagnetic wand 30, a pivot assembly 70, a ramp assembly 80, another ramp 140 and a controller assembly 158 that includes a microcontroller 160.

Referring to FIGS. 2–5, wand 30 preferably comprises a cylindrical core formed as a rod 32 about 12 to 15 inches long from ferromagnetic material. Rod 32 may be fabricated from any conventional magnetic material, such as the material found in the cores of transformers. An electrical coil 34 is wound around rod 32. The opposed ends of coil 34 are connected to conductors 35A and 35B which received control signals from a controller, such as microcontroller 160. Wand 30 also includes a generally cylindrical cover 36 having a bottom surface 38, a left end 40, a right end 42, and a top surface 44. Wand 30 defines a path 46 on bottom surface 38 along which pinball 22 moves as it is being carried by wand 30. Path 46 is placed at an angle of about 6 degrees with respect to a horizontal plane so that pinball 22 is urged by gravity to move away from end 40 toward end 42 as pinball 22 is being carried by wand 30.

FIGS. 2A–5A illustrate an alternative form of wand 30A which comprises a generally U-shaped core 52 made from ferromagnetic material. Core 52 may be fabricated from any conventional magnetic material, such as the material found in the cores of transformers. An electrical coil 54 is wound around core 52. The opposed ends of coil 54 are connected to conductors 55A and 55B which received control signals from a controller, such as microcontroller 160. Wand 30A also includes a generally cylindrical cover 56 having a bottom surface 58, a left end 60, a right 3nd 62, and a top surface 64. Wand 30A defines a path 66 on bottom surface 58 along which pinball 22 moves as it is being carried by wand 30A. The distance from end 60 to end 62 is about 12 to 15 inches. Path 66 is placed at an angle of about 6 degrees with respect to a horizontal plane so that pinball 22 is urged by gravity to move away from end 60 toward end 62 as pinball 22 is being carried by wand 30. As shown in FIG. 4A, controller assembly 158 may comprise a photo detector 164 that is embedded in wand 30A and has a lower edge flush with surface 58. When pinball 22 rolls from end 60 to end 62 it blocks a light beam when it rolls over detector 164 and sends a detection signal to microcontroller 160 by conductors (not shown) that are built into wand 30A. Wand 30 can be provided with a similar pinball detection device. Controller assembly also includes a photo detector 165 that is embedded in wand 30A and has a lower edge flush with surface 58. Photo detector 165 receives a beam of light from one of the pinball ramps and generates a detection signal that is sent to microcontroller 160 by conductors (not shown) that are built into wand 30A. The operation of detector 165 is explained in connection with FIG. 8.

Referring to FIG. 1, pivot assembly 70 includes a rotatable support column 72 that supports cantilevered wand 30 near end 40. Column 72 is rotated by and is carried by the shaft of a conventional motor 74 which receives control signals from microcontroller 160 over a bus 76. Column 72 extends through a cylindrical hole in surface 22 as shown.

Figure 6:
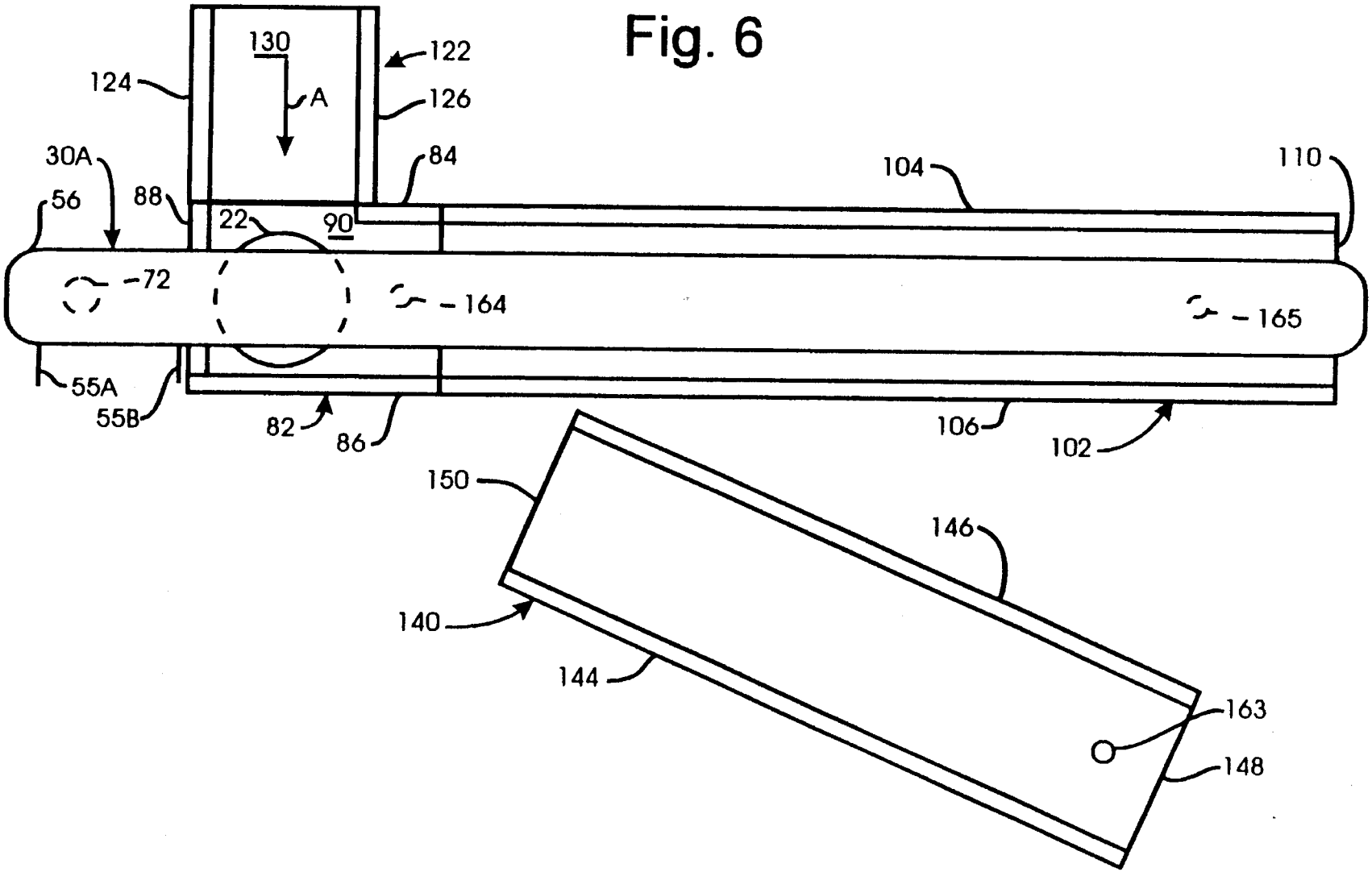
FIG. 6 is a top plan view of the apparatus shown in FIG. 1 with the pinball repositioned to the left of the position shown in FIG. 1 and utilizing the alternative form of wand shown in FIGS. 2A–5A and is rotated into alignment with a first ramp.

Referring to FIGS. 1 and 6, ramp assembly 80 comprises sections 82, 102, and 122. Section 82 includes side rails 84 and 86, a back rail 88 and a bottom surface 90. Section 102 includes side rails 104 and 106 and a bottom surface 110. Section 122 includes side rails 124 and 126, and a bottom surface 130. Ramp assembly 80 is supported by conventional posts, such as posts 132 and 134.

Still referring to FIGS. 1 and 6, ramp 140 includes side rails 144 and 146, an exit end 148 and a bottom surface 150. A light-emitting diode 163 is embedded in surface 150 and projects a beam of light upward that is intercepted by detector 165 when wand 30A is rotated to a position over ramp 140. Diode 163 forms part of the control assembly. Ramp 140 is supported by conventional posts, such as posts 152 and 154. End 148 rests on game surface 22.

Figure 1A:
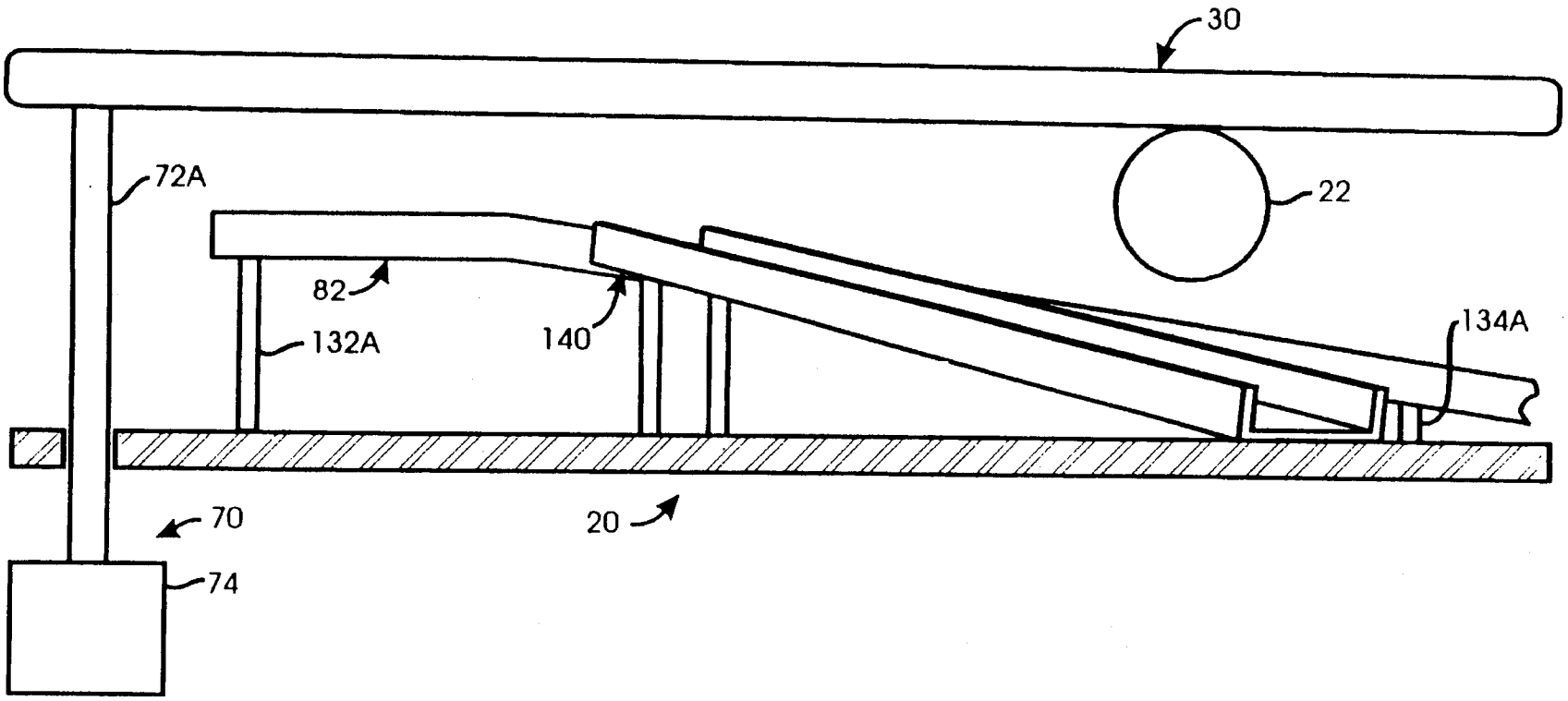
FIG. 1A is a fragmentary, side elevational view of an alternative form of the apparatus shown in FIG. 1.
Figure 2:
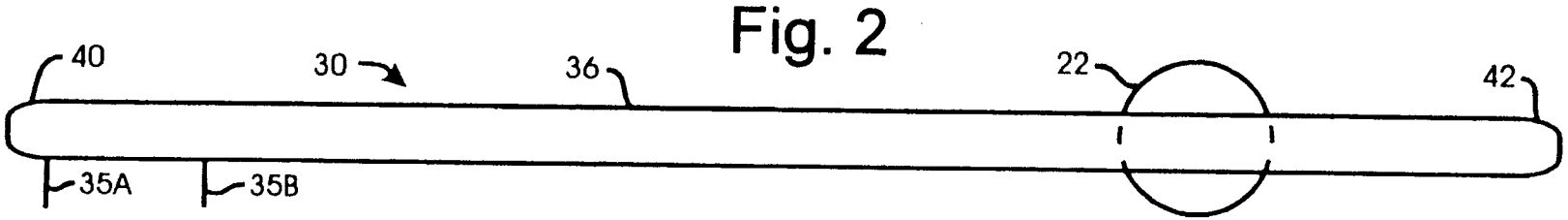
FIG. 2 is a top plan view of the wand shown in FIG. 1 while carrying a pinball adjacent the bottom surface of the wand.
Figure 3:
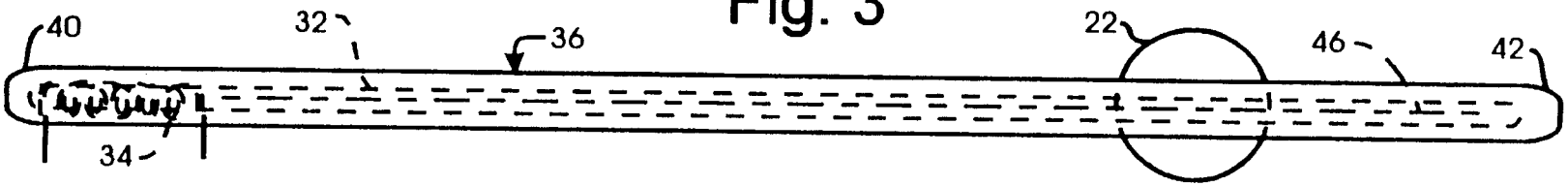
FIG. 3 is a top plan view of the wand shown in FIG. 2 illustrating the internal parts.
Figure 4:
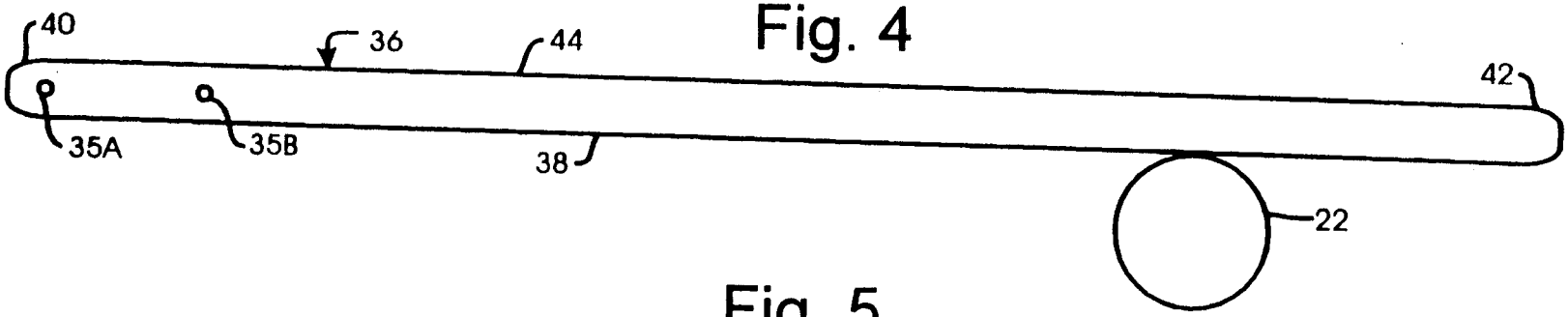
FIG. 4 is a side elevational view of the wand shown in FIG. 2.
Figure 5:
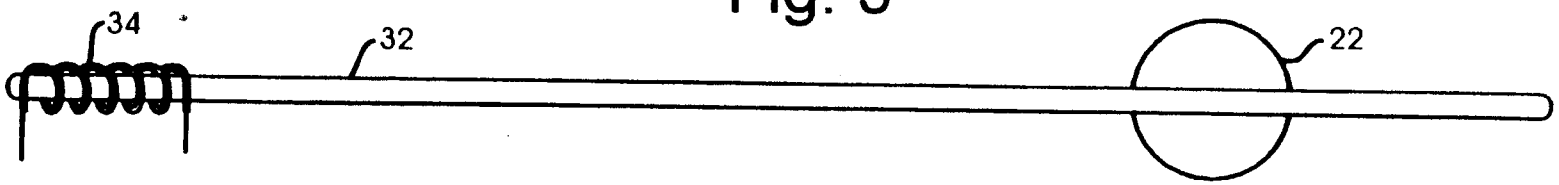
FIG. 5 is a top plan view of the internal parts of the wand shown in dotted lines in FIG. 3.
Figures 2A, 3A, 4A, 5A:
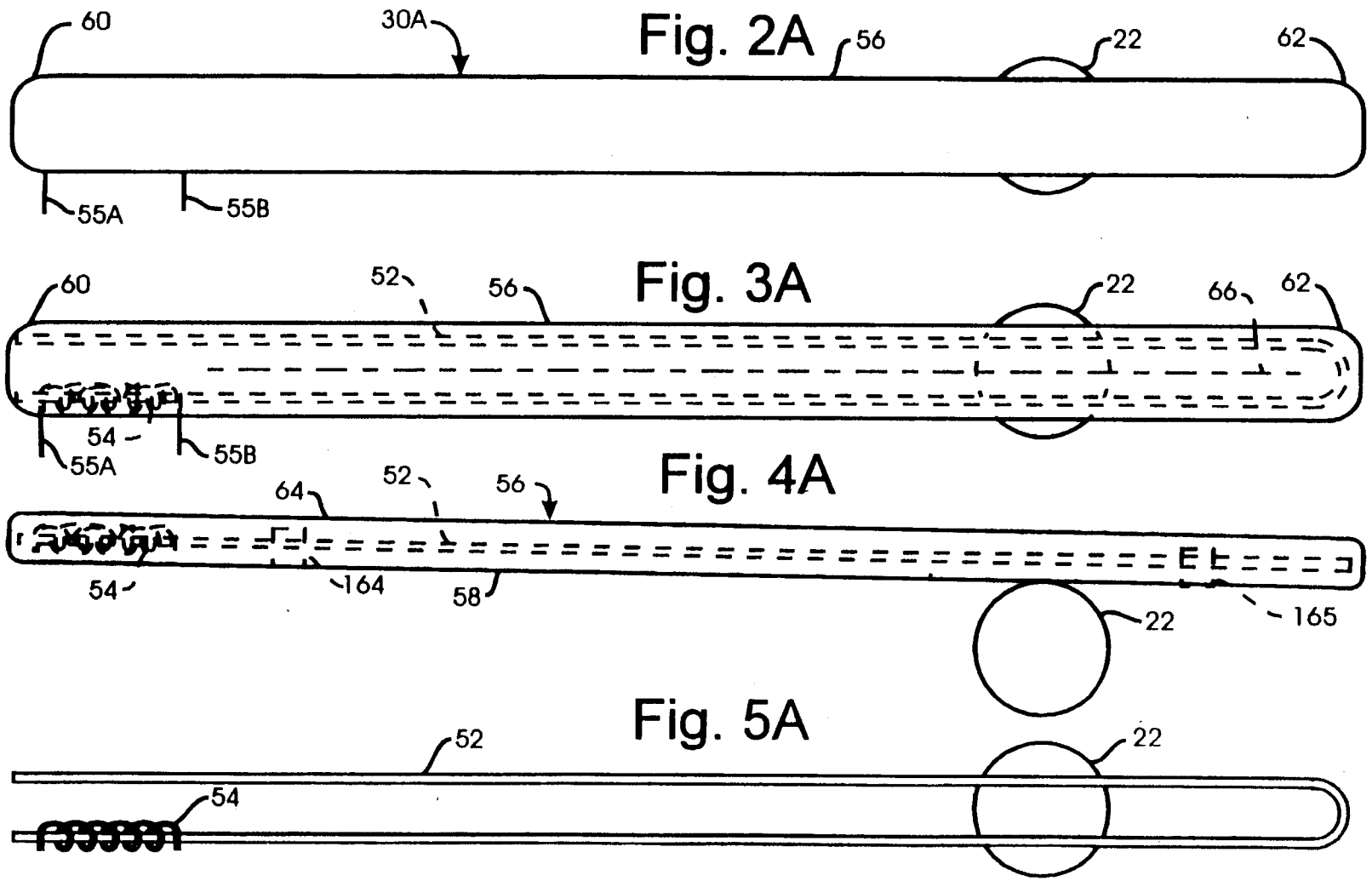
FIG. 2A is a top plan view of an alternative form of the wand shown in FIG. 2.
FIG. 3A is a top plan view of the wand shown in FIG. 2A illustrating the internal parts.
FIG. 4A is a side elevational view of the wand shown in FIG. 3A.
FIG. 5A is a top plan view of the internal parts of the wand shown in dotted lines in FIG. 3A.

As shown in FIG. 1, ramp assembly 80 and ramp 140 are located at substantially the same vertical levels. FIG. 1A illustrates an alternative form of game in which ramp assembly 80 and ramp 140 are at substantially different vertical levels. This arrangement is achieved by providing a column 72A and posts 132A and 134A which are shorter than their like-numbered counterparts shown in FIG. 1. In the arrangement shown in FIG. 1A, bottom surface 150 of ramp 140 can include shock absorbing material in order to avoid noise when pinball 22 is dropped onto the surface. Alternatively, bottom 150 can comprise sound enhancing material which will create sound when pinball 22 is dropped onto bottom 150. Such material may be sheet metal tuned to create sound when pinball 22 is dropped onto its surface. The sound may be amplified, if desired, to emphasize to the player that pinball 22 has been moved to a different ramp.

Referring to FIGS. 1, 4A, 6 and 8, controller assembly 158 includes a light-emitting diode 162 that is held in bottom surface 90 so that it projects a beam of light upward toward wand 30A. The light beam is received by photo detector 164 included in wand 30A. If no light is detected, pinball 22 is over detector 164, and detector 164 generates a detection signal that is transmitted to microcontroller 160 to indicate that pinball 22 is intercepting the beam. Assembly 158 also includes light-emitting diode 163 embedded in surface 150 of ramp 140. Diode 163 emits a beam of light in an upward direction. When wand 30A is rotated over ramp 140, the beam of light is received by a photo detector 165 embedded in wand 30A. In response to receipt of the light beam, detector 165 generates a detection signal indicating to microcontroller 160 that wand 30A is properly positioned over ramp 140.

Figure 7:
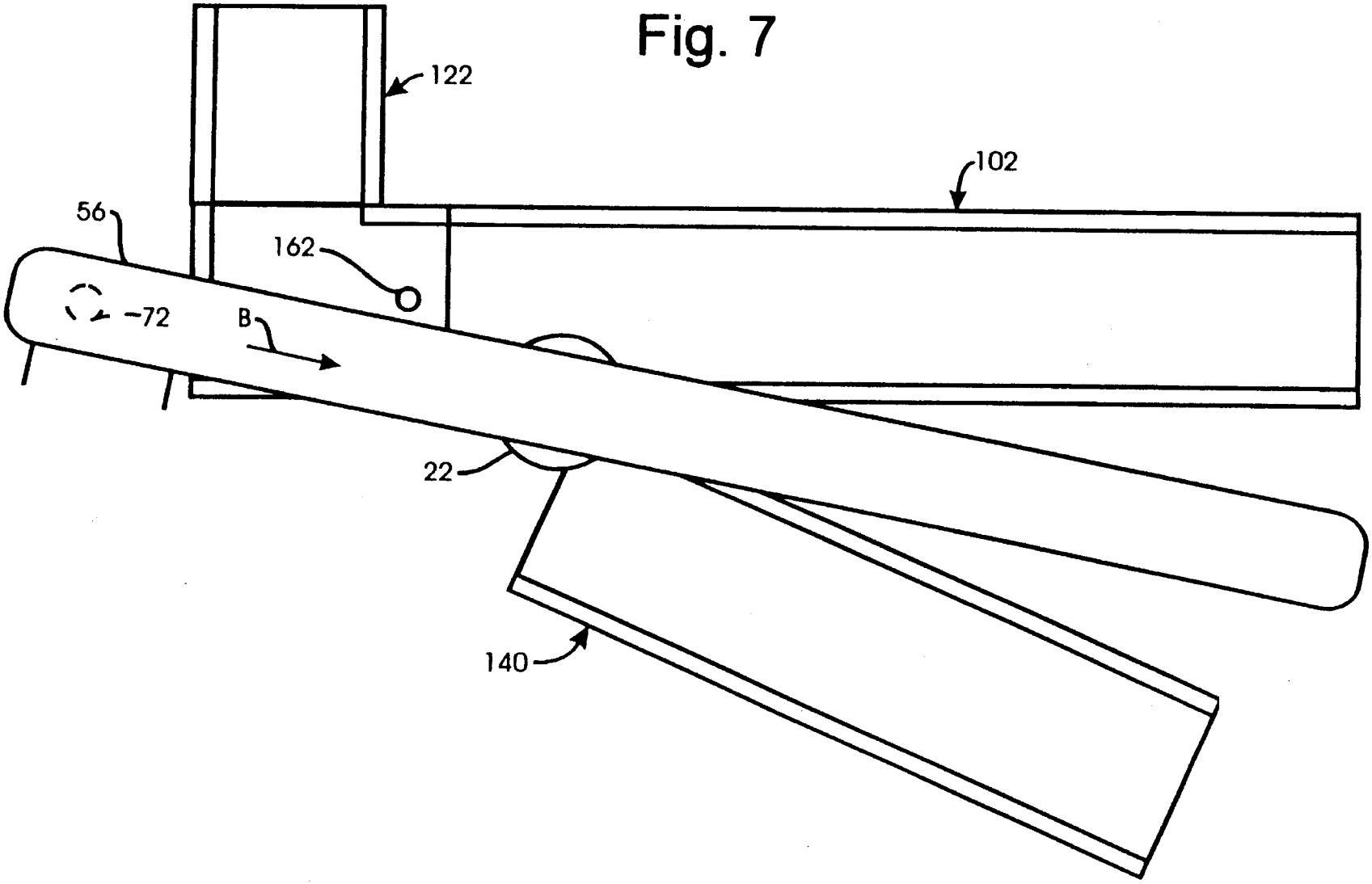
FIG. 7 is a top plan view of the apparatus shown in FIG. 6 with the wand rotated and the pinball moved along the bottom surface of the wand.
Figure 8:
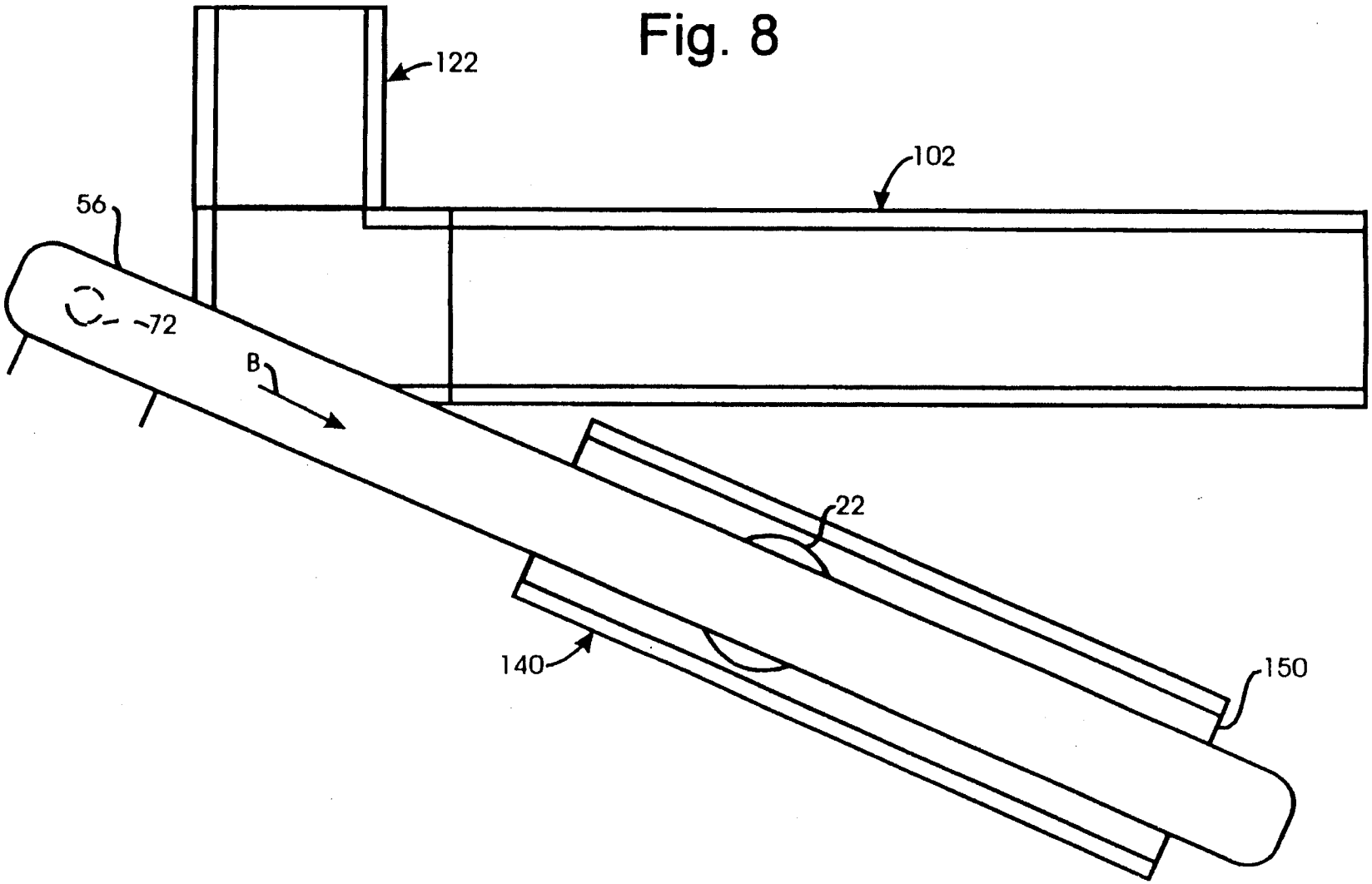
FIG. 8 is a top plan view of the apparatus shown in FIG. 7 with the wand rotated into alignment with a second ramp and the pinball moved along the bottom surface of the wand to a position in which the pinball can be released from the wand so that it will drop onto the second ramp.

The operation of the wand is described in connection with FIGS. 6–8. As shown in FIG. 6, ball 22 is directed adjacent wand 30A by any convenient means. For example, the player may direct the ball by skillful aiming to an up ramp that terminates in ramp section 122. Pinball 22 proceeds in the direction of arrow A and is slowed or substantially stopped by contact with side rail 86 so that it comes to the position shown in FIG. 6. A switch (not shown) detects the presence of pinball 22 in section 122 and sends a detection signal to microcontroller 160. In response to the detection signal from the switch, microcontroller 160 energizes coil 54 so that pinball 22 is electromagnetically attracted toward wand 30A. Pinball 22 then is carried by wand 30A. Bottom surface 90 of ramp section 82 makes a slight angle with respect to a horizontal plane. Surface 90 can be substantially parallel with bottom surface 58 so that pinball 22 slowly rolls along surface 58 toward end 62 of wand 30A and toward ramp section 102 in the direction of arrow B.

As soon as pinball 22 interrupts the light beam produced by diode 162, detector 164 generates a detection signal from detector 164, microcontroller 160 begins to turn motor 74 so that wand 30A is rotated clockwise as seen in FIG. 6. Referring to FIG. 7, pinball 22 continues to roll along the bottom surface of wand 30A in the direction of arrow B and the wand continues to rotate to the position shown. When wand 30A and pinball 22 arrive at the positions shown in FIG. 8, detector 165 intercepts the light beam from diode 163 embedded in surface 150 of ramp 140. In response to the light beam, detector 165 generates a detection signal indicating that wand 30A is properly positioned over ramp 140. The detection signal is transmitted to microcontroller 160 which stops motor 74 and deenergizes coil 54 so that pinball 22 drops onto bottom surface 150 of ramp 140. Pinball 22 rolls by gravity to surface 22.

Those skilled in the art can program microcontroller 160 to control the coils and motor 74 in the manner described. Alternatively, a conventional relay control can be utilized to achieve the same mode of operation.

Figure 9:
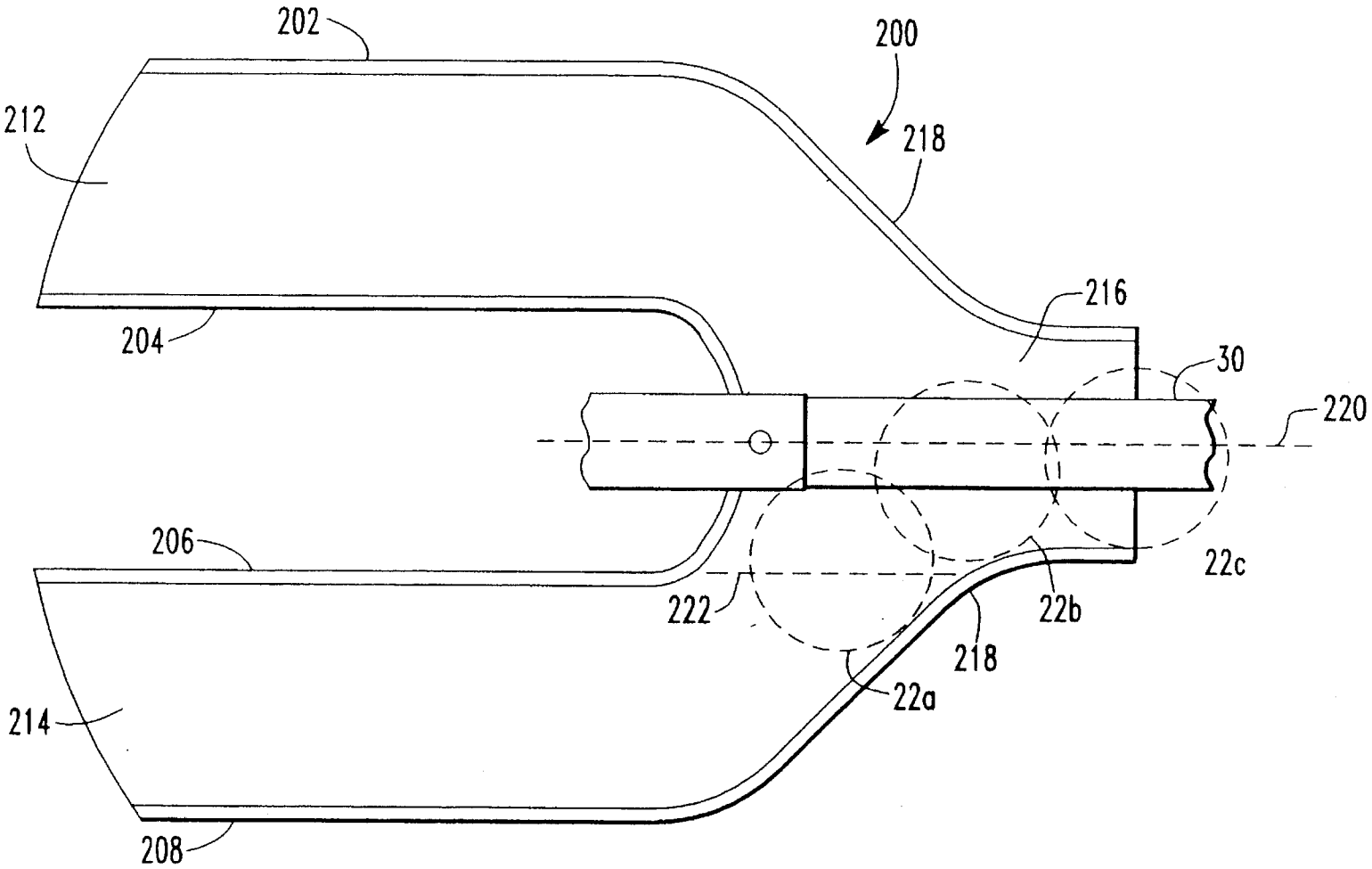
FIG. 9 is a top plan view of a platform for use with the wand assembly illustrated in FIG. 1.
Figure 10:
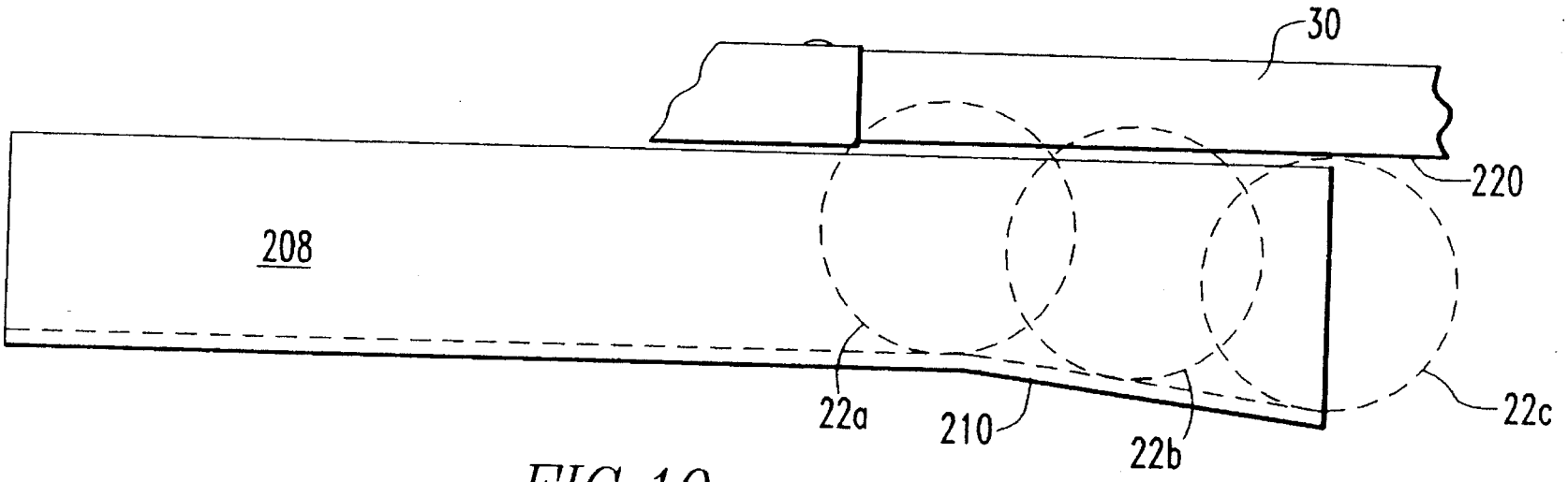
FIG. 10 is a side elevational view of the platform shown in FIG. 9.

Turning to FIGS. 9 and 10, illustrated is a further embodiment of a platform 200 which is used in conjunction with the previously described ramp assembly 80 for the purpose of further assisting the pinball 22 into contact with the wand 30. The platform 200, preferably constructed from molded plastic or the like, consists of walls 202, 204, 206, and 208 and a floor or running surface 210. A first entry channel 212 is created between the walls 202 and 204 and a second entry channel 214 is created between the walls 206 and 208. It is to be understood that any number of entry channels may be utilized. An exit channel 216 is created between the walls 202 and 208. Each pair of walls which creates a channel is separated by a width large enough to accommodate a standard pinball. Furthermore, the height of each of the walls is slightly below that of a standard pinball.

Positioned in the center of the platform 200 is the moving mechanism (not shown) from which extends the wand 30. As illustrated, the wand 30 is preferably positioned at a height above the walls whereby the wand 30 is free to rotate from side to side. The floor 210 of the platform 200 in the vicinity of the exit channel 216 is preferably inclined at an angle slightly greater than the angle of incline of the wand 30, which has been described to be approximately 6 degrees from horizontal. As previously described, an optical sensor may be positioned in the wand 30 to detect the presence of the pinball for the purpose of activating the electromagnet. In the alternative, an optical sensor may be positioned on the platform 200 for use in detecting the pinball and activating the electromagnet.

In operation, the pinball will be caused to enter one of the entrance channels 212, 214 during the course of play where the pinball will be directed by the entry channel towards the exit channel 216. In the preferred embodiment, the floor 210 of the platform 200 is generally positioned in a plane parallel to that of the playfield 24 (and the wand 30) such that the floor 210 is inclined at an angle of approximately 6 degrees. The inclination of the floor 210 allows gravity to move the pinball towards the exit channel 216. The pinball proceeds down the entry channel until it contacts a curvature 218 in the outer wall which curvature directs the ball into contact with the wand 30.

As the pinball is directed into contact with the wand 30, at position 22*a*, the pinball initially contacts the wand 30 to one side of the center line 220 (corresponding to the lower most wand surface) of the wand 30. Likewise, at position 22*a*, the pinball also contacts the wand 30 off its center line 222 such that the pinball makes contact with the wand 30 at a height below the maximum height of the pinball. As the pinball proceeds from the initial contact position 22*a* to an intermediate contact position 22*b* the curve 218 in the channel wall continues to press the pinball against the wand 30. In the intermediate contact position 22*b* the pinball is forced closer to the center line 220 of the wand 30 by moving further thereunder. This movement to a position further under the wand 30 is allowed by the drop off or extra incline given to the exit channel 216. Correspondingly, as the pinball is forced further under the wand 30, the pinball continues contact with the wand 30 closer to its center line 222 and closer to a height equal to the maximum height of the pinball. As the pinball continues from the intermediate position 22*b* to the exit position 22*c* the curve 218 finally forces the pinball completely under the wand 30. Specifically, upon reaching the exit position 22*c*, the pinball center line 222 and the wand center line 220 are substantially aligned and the pinball contacts the wand 30 at its highest most point.

It is seen that this platform configuration allows the pinball to be smoothly positioned under the wand 30 such that the electromagnetic contact between the wand 30 and the pinball is ensured. It is also seen that this platform configuration ensures that the pinball will exit the platform with the center lines of the pinball and wand aligned such that the pinball will not have cause to move to seek this alignment (which movement would necessarily be forced by gravity) where such movement may cause the dislodgment of the pinball from the wand 30.

Those skilled in the art will recognize that the preferred embodiments may be altered and amended without departing from the true spirit and scope of the invention as defined in the accompanying claims.

What is claimed is:

1. In a pinball game utilizing a pinball rolling on a game surface, an apparatus for maneuvering said pinball comprising:

an electromagnet for carrying said pinball below said electromagnet wherein said electromagnet defines a path lying in a plane that intersects a horizontal plane so that said pinball is urged by gravity to move along said electromagnet while being carried by said electromagnet; and a platform positioned adjacent said electromagnet for directing said pinball from a first contact position with respect to said electromagnet to a second contact position with respect to said electromagnet.

2. The apparatus as defined in claim 1, wherein said first contact position comprises said pinball contacting said electromagnet at a location displaced from an electromagnet bisecting line and said second contact position comprises said pinball contacting said electromagnet at a location along said electromagnet bisecting line.

3. The apparatus as defined in claim 2, wherein said electromagnet is generally cylindrical in shape.

4. The apparatus as defined in claim 2 wherein said platform has an entry channel for directing said pinball to said first contact position and an exit channel whereby said pinball exits said platform in said second contact position.

5. In a pinball game utilizing a pinball rolling on a game surface, an apparatus for transporting said pinball comprising:

a platform having a path for guiding said pinball to first and second locations; and an elongated electromagnet having a first end adjacent said path and a second end displaced from said path whereby said pinball is carried along the length of said electromagnet from said first end to said second end for moving said pinball away from said path, said electromagnet further having a side surface and a bottom surface;

wherein said first location comprises said pinball contacting said electromagnet at a location along said side surface of said electromagnet and said second location comprises said pinball contacting said electromagnet at a location along said bottom surface of said electromagnet.

6. The apparatus as defined in claim 5, wherein said path is inclined relative to horizontal.

7. The apparatus as defined in claim 6, wherein said electromagnet is generally cylindrical in shape and said bottom surface runs along a line generally bisecting said electromagnet.

8. In a pinball game utilizing a pinball rolling on a game surface, an apparatus for moving said pinball comprising:

an electromagnet having a first end and a second end for carrying said pinball below said electromagnet wherein said electromagnet defines a path lying in a plane that intersects a horizontal plane so that said pinball is urged by gravity to move along said electromagnet while being carried by said electromagnet;

a platform positioned under said first end for urging said pinball into a position of contact under said electromagnet; and control means for energizing said electromagnet while said pinball is on said platform in order that said pinball may be carried from said platform to a remote location spaced from said platform and positioned adjacent said second end and for further deenergizing said electromagnet in order that said pinball may be released from said electromagnet when said pinball arrives at said remote location.

* * * * *